US007735404B2

(12) United States Patent
Wilk

(10) Patent No.: US 7,735,404 B2
(45) Date of Patent: Jun. 15, 2010

(54) BELT SKIVER APPARATUS

(75) Inventor: Thomas Wilk, Muhlheim (DE)

(73) Assignee: MATO Maschinen-und Metallwarenfabrik Curt Matthaei GmbH & Co. KG (DE)

( * ) Notice: Subject to any disclaimer, the term of this patent is extended or adjusted under 35 U.S.C. 154(b) by 225 days.

(21) Appl. No.: 11/787,470

(22) Filed: Apr. 17, 2007

(65) Prior Publication Data

US 2007/0283796 A1 Dec. 13, 2007

(30) Foreign Application Priority Data

Apr. 29, 2006 (EP) ..... 06009001

(51) Int. Cl.
*B26D 3/28* (2006.01)

(52) U.S. Cl. ..... 83/869; 83/875; 83/935

(58) Field of Classification Search ..... 83/861, 83/862–865, 935, 869, 875; 30/294
See application file for complete search history.

(56) References Cited

U.S. PATENT DOCUMENTS

| | | | | | |
|---|---|---|---|---|---|
| 1,307,151 | A | * | 6/1919 | Rowden et al. | 30/294 |
| 2,706,002 | A | * | 4/1955 | Whittamore | 83/885 |
| 2,734,535 | A | * | 2/1956 | Neubauer | 30/481 |
| 3,336,700 | A | * | 8/1967 | Kuzmik | 451/67 |
| 4,064,775 | A | * | 12/1977 | Larson | 83/874 |
| 4,315,450 | A | * | 2/1982 | Pray | 83/862 |
| 4,656,910 | A | * | 4/1987 | Peterson | 83/875 |
| 5,486,133 | A | * | 1/1996 | Russell | 451/150 |
| 5,676,794 | A | * | 10/1997 | Baley | 156/584 |
| 5,771,586 | A | * | 6/1998 | Lotarski et al. | 30/293 |
| 5,771,587 | A | * | 6/1998 | Herold | 30/294 |
| 5,809,822 | A | * | 9/1998 | Butty | 72/275 |
| 5,852,877 | A | * | 12/1998 | Lotarski et al. | 30/290 |
| 5,865,085 | A | * | 2/1999 | Vollenweider | 83/861 |
| 5,974,935 | A | * | 11/1999 | Willis et al. | 83/870 |
| 6,751,876 | B2 | * | 6/2004 | Herold | 30/486 |
| 6,774,978 | B2 | * | 8/2004 | Shin | 349/187 |

FOREIGN PATENT DOCUMENTS

| | | | |
|---|---|---|---|
| DE | 4002116 A1 | | 8/1990 |
| GB | 2227703 | * | 8/1990 |
| GB | 2227703 A | | 8/1990 |
| WO | WO 96/07517 | * | 3/1996 |

* cited by examiner

*Primary Examiner*—Kenneth E. Peterson
*Assistant Examiner*—Sean Michalski
(74) *Attorney, Agent, or Firm*—Price, Heneveld, Cooper, DeWitt & Litton, LLP

(57) ABSTRACT

A belt skiver is adapted for forming recesses along a conveyor belt end in preparation for mounting a lacing therein. The belt skiver includes a cutting mechanism movable relative to the conveyor belt end, and having an upper blade positioned to remove an upper surface layer from a top portion of the conveyor belt, and a lower plate positioned to remove a lower surface layer from a bottom portion of the conveyor belt. The belt skiver also includes a drive mechanism shifting the cutting mechanism relative to the belt end laterally along the belt end, and whereby the upper and lower blades contemporaneously sever both the upper surface layer and lower surface layer from the belt end.

23 Claims, 7 Drawing Sheets

BELT SKIVER APPARATUS

CLAIM OF PRIORITY

Applicant hereby claims the priority benefits under the provisions of 35 U.S.C. §119, basing said claim of priority on European Patent Application Serial No. 06 009 001.6, filed Apr. 29, 2006. In accordance with the provisions of 35 U.S.C. §119 and Rule 55(b), a certified copy of the above-listed European patent application will be filed before grant of a patent.

BACKGROUND OF THE INVENTION

The invention relates to a belt skiver apparatus for separating surface layers or strips from the ends of a conveyor belt, and in particular to a belt skiver mechanism that moves relative to the conveyor belt and contemporaneously separates both the upper and lower surface layers of the belt ends using blades.

Belt skivers particularly serve the purpose of reducing the thickness of a conveyor belt at the area of the two ends, so that within the reduced thickness areas or recesses, metallic belt connectors can be positioned and attached. Belt skivers advantageously remove strips from the ends of the conveyor belt, which have a thickness smaller than the thickness of the conveyor belt before separating the surface layers. The belt connectors are positioned in the recesses formed thereby at the opposing ends of the conveyor belt. Some types of belt connectors have plates that span between the opposite ends of the belt, while other types of belt connectors have loops or eyelets that are arranged in an overlapping or intermeshing arrangement, and are interconnected by a rod or pin inserted through the eyelets of the belt connectors to permit the belt to travel in a circular or arcuate pattern at the ends of the conveyor.

Within the spirit of the present invention, the term "surface layer" is to be understood on a broad basis. The surface layers of the conveyor belt typically reference the upper and lower surfaces of the conveyor belt. The thickness of the particular surface layers to be separated is determined by the size and geometry of the metallic belt connectors to be attached to the belt ends.

A mechanism of the type discussed above, which is identified herein as a belt skiver or plane, is disclosed in DE 40 02 116 A1. The mechanical belt skiver described in this prior patent document serves the purpose of separating a surface layer from an end of a conveyor belt clamped on a support mechanism. The belt skiver has a slide movable along the support mechanism, in which a blade and leading pressure shoe are mounted in a vertically adjustable manner that corresponds to the thickness of the surface layer to be cut and/or the thickness of the conveyor belt. The blade is formed as a knife, the free end of which is disposed away from the slide, and is high curved, in order to cut the surface layer both vertically and horizontally. The slide is moved by means of a gear that is able to be operated by a crank handle. Due to the gear reduction ratio of the gearbox, the blade can be moved over the belt with great force or strength. The blade is relatively thick and therefore bend resistant to ensure that a continuous surface layer size is removed over the entire width of the belt.

However, this type of mechanical belt skiver has certain disadvantageous such as, upon the operation of the belt skiver relative to the clamped conveyor belt, the surface layer can be removed only on one side or face of the conveyor belt end. When the surface layer is to be removed on the other side or face of the conveyor belt end, it is necessary to disconnect and remove the clamp holding the conveyor belt, subsequently putting back the belt skiver into the starting position, once again aligning and clamping the turned over conveyor belt on the support mechanism, and subsequently performing the additional separation process. Apart from the additional handling being quite labor-consuming and time-consuming, it also results in the risk that the turned over conveyor belt changes position or is misaligned in the support mechanism relative to the first side, with the consequence being that, upon separating the two surface layers or strips, deviations are experienced. Apart from this, due to the use of only one blade with the belt skiver, this does not facilitate the separating of different geometrical surface layers from the end of a conveyor belt.

Furthermore, another mechanism of the type discussed above is disclosed in WO 96/07517. This mechanism also has a blade for separating the surface layers of the conveyor belt. This mechanism is provided with two mounted rollers pivoting on parallel axles with the full thickness conveyor belt clamped therebetween. One roller is actuated, so that the conveyor belt is conveyed by the rollers. The blade is housed behind the rollers in the direction of the conveyance of the conveyor belt, which thus separates the surface layer from the conveyor belt. The mechanism is free standing, so that it is not necessary to position the conveyor belt in a stationary manner. Rather, the conveyor belt is introduced in the mechanism and transported by means of the rollers through the mechanism and the surface layer is thereby separated.

Also for this mechanism, there is a particular disadvantage insofar as the relative shifting of the mechanism and the conveyor belt results in only one surface layer being separated from the relevant end of the conveyor belt. If two surface layers are to be separated from the conveyor belt end, the procedure must be repeated, with the above-described problems concerning the accuracy of the separated surface layers. This is a prerequisite for the exact positioning of the belt connectors.

SUMMARY OF THE INVENTION

One objective of the present invention is to provide improvements to belt skivers of the type discussed above, so the opposite surface layers of a conveyor belt can be quickly and precisely separated from the conveyor belt ends at the same time.

Another disadvantage associated with prior art belt skiver mechanisms is solved by providing two blades in the present invention, whereby one blade separates the surface layer on one side of the conveyor belt and other blade separates the surface layer on the other side of the conveyor belt.

In the present invention, the mechanism cuts or separates both the upper and lower surface layers of the belt ends by movement of the belt skiver mechanism relative to the conveyor belt. Thus, it is not necessary to reclamp the conveyor belt or realign the belt skiver mechanism. The belt skiver mechanism does not have to be reset. Moreover, with the present separation process, the two blades are arranged in a manner that is fixed relative to each other, such that, if there is no deliberate adjustment of the blades, the same cut or separation pattern is always achieved at each end of the conveyor belt.

Within the spirit of the present invention, it is not necessary that the two blades initiate the separation process at the same time. By all means, it can be desired to commence the separation process sequentially, i.e., one blade in the conveyor belt initially enters to separate the surface layer and, at some point later, the other blade in the conveyor belt enters in order to separate the other surface layer of the belt end.

Within the spirit of the present invention, only one motion of the mechanism relative to the conveyor belt is necessary. This relative motion can be achieved in various methods, for example by a stationary suspension of the conveyor belt and the movement of the belt skiver mechanism relative to the conveyor belt, or by a freely mobile belt skiver mechanism that is provided with an actuator that pulls the conveyor belt through the mechanism. This embodiment of the belt skiver mechanism can be arranged with clamping rollers (for example, in the sense of the described state of the art), which are actuated. It is also conceivable to mount the belt skiver mechanism in a stationary manner, and clamp the conveyor belt to a mobile slide, in order to produce the relative movement between the conveyor belt and the belt skiver mechanism.

The blades that are used for the belt skiver mechanism can have different configurations in order to effect different cross section geometries of the planed off surface layers, and thus different geometries of the offsets or recesses in the conveyor belt ends. On the basis of the differently arranged offsets of the conveyor belts, the circulating conveyor can be optimized with respect to the belt connectors attached to the ends of the conveyor belt, since, in the recessed areas of the conveyor belt ends, various offset geometries are possible, so that the pressed internal section of the front belt makes contact with the guide rollers of the conveyor.

In one working embodiment of the present invention, the blades advantageously exhibit cutting edges that are arranged in a manner that is parallel to each other. Thereby, upon separating the surface layers, parallel offsets are formed in the conveyor belt. At least one of the blades can be adjusted relative to the thickness of the conveyor belt, in order to be able to vary the thickness of the recesses and the remaining portion of the conveyor belt. Furthermore, at least one of the blades should be adjustable in a manner that is perpendicular to the thickness of the conveyor belt. This makes it possible it to change the dimension of the surface layer to which the adjustable blade is assigned in a manner that is perpendicular to the running direction of the conveyor in the band section concerned. The cutting edge of the blade, related to the relative operating direction of the mechanism and the conveyor belt, can be arranged before the cutting edge of the other blade, as described above.

In one embodiment of the present invention, each blade advantageously exhibits a central section and at least one trailing edge section, which may include two edge sections following the central section. The cutting edges of the central sections may be arranged in a manner that is parallel to each other. The edge sections may be arranged in a right to obtuse angle to the central section. As a result of this configuration, the belt skiver mechanism is usable on a wide variety of applications. Depending upon the blade geometry that is used, different surface layer cross sections can be planed off the conveyor belt ends.

During the relative motion of the belt skiver mechanism and the conveyor belt, in order to drive the two blades precisely through the conveyor belt ends, it is preferable that the belt skiver mechanism have guide plates for leading or guiding the blades through the conveyor belt. The position of the guide plates is preferably selected in such a way that the conveyor belt can be moved through the guide plates with little clearance. So that the mechanism is usable with different conveyor belt thicknesses, at least one of the guide plates is adjustable relative to the position of the conveyor belt.

Appropriately, the blades are arranged behind the guide plates in the direction of motion of the conveyor belt relative to the belt skiver mechanism. Thus, it is ensured that the conveyor belt and blades move in a manner that is exactly aligned with the blade area. It is preferable that the guide plates are supported by means that ensure lateral alignment with the conveyor belt, such that forced guidance of the belt skiver mechanism and the conveyor belt is achieved.

Under a specific embodiment, it is intended that the conveyor belt is mounted in a stationary manner (particularly clamped in a support mechanism) and the belt skiver mechanism is movable.

Specifically, the belt skiver mechanism is disposed in a stationary control mechanism (particularly in one control mechanism), which forms one structural unit with the support mechanism. Thereby, a predefined relationship among the belt skiver mechanism, the stationary control mechanism and the support mechanism is achieved.

To move the belt skiver mechanism along the control mechanism, an actuator is preferably provided, having a mechanical advantage, particularly exhibiting the operation of a pinion gear that engages with the control mechanism with a gear rod or a perforated rod. The actuator may be operated by hand. In this respect, a crank handle is provided for the rotation of the pinion gear, whereby a reduction gear between the crank handle and the pinion gear is advantageously achieved.

It is to be understood that the relative motion of the belt skiver mechanism and the conveyor belt can be also be effected with other methods and/or devices. It is particularly contemplated that the belt skiver mechanism may be mounted in a stationary manner and that the conveyor belt is movable through the belt skiver mechanism.

Additional characteristics and features of the invention are represented in the claims, in the description of the figures and in the figures themselves, whereby it is observed that all individual characteristics and all combinations of individual characteristics represent additional embodiments under the invention.

These and other advantages of the invention will be further understood and appreciated by those skilled in the art by reference to the following written specification, claims and appended drawings.

BRIEF DESCRIPTION OF THE DRAWINGS

In the figures, the invention is described on the basis of examples of embodiments, without being limited thereof. It shows.

DETAILED DESCRIPTION OF THE PREFERRED EMBODIMENTS

Figure 1:
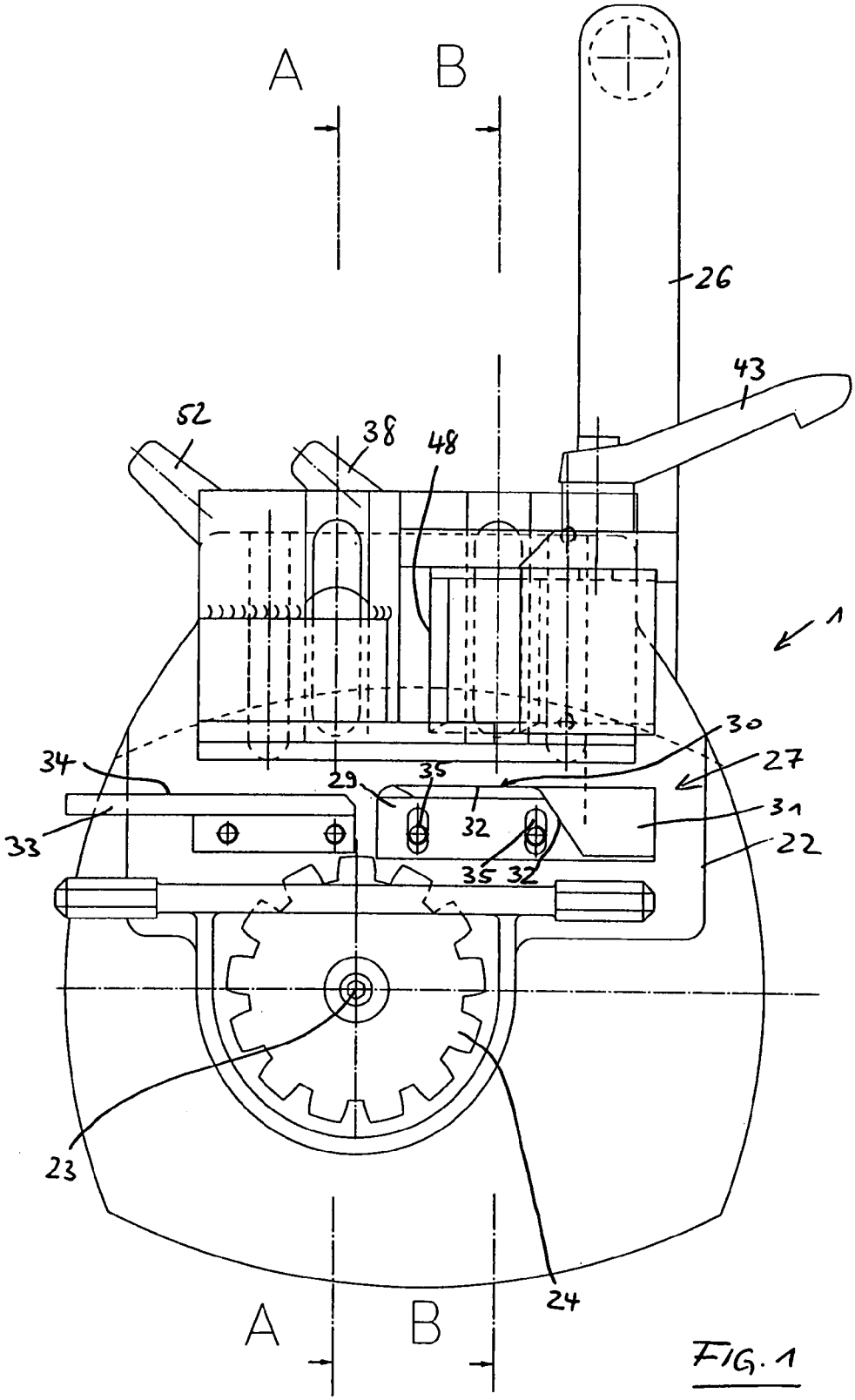
FIG. 1 a side view of the belt skiver mechanism embodying the present invention for separating surface layers from the end of a conveyor belt, FIG. 2 an A-A cut in accordance with FIG. 1 through the mechanism for separating surface layers along with a control mechanism incorporated in this mechanism in a stationary manner and a singular structural unit with the support mechanism forming the stationary control mechanism for the conveyor belt this is also partially illustrated, FIG. 3 a cut that is located in parallel to the A-A cut under FIG. 1 by the structural unit made of the stationary control mechanism and the support mechanism, FIG. 4 a cut through the mechanism along the line B-B in FIG. 1, with a partially illustrated conveyor belt, FIG. 5 a top view of the mechanism under FIG. 1, with a partially illustrated conveyor belt, FIG. 6 a cut through the arrangement of the functional components shown in FIG. 2, cut in accordance with line X-X in FIG. 2, FIG. 7 a cut in accordance with FIG. 4 through the mechanism for separating surface layers, whereby the mechanism shown in FIG. 7 possesses a modified lower blade, and FIG. 8 a cut through the neighboring belt ends of a conveyor belt, which are connected by means of connectors and a clutch rod or pin to illustrate the separation pattern of the particular belt ends that are produced by means of the mechanism shown in FIG. 7.
Figure 2:
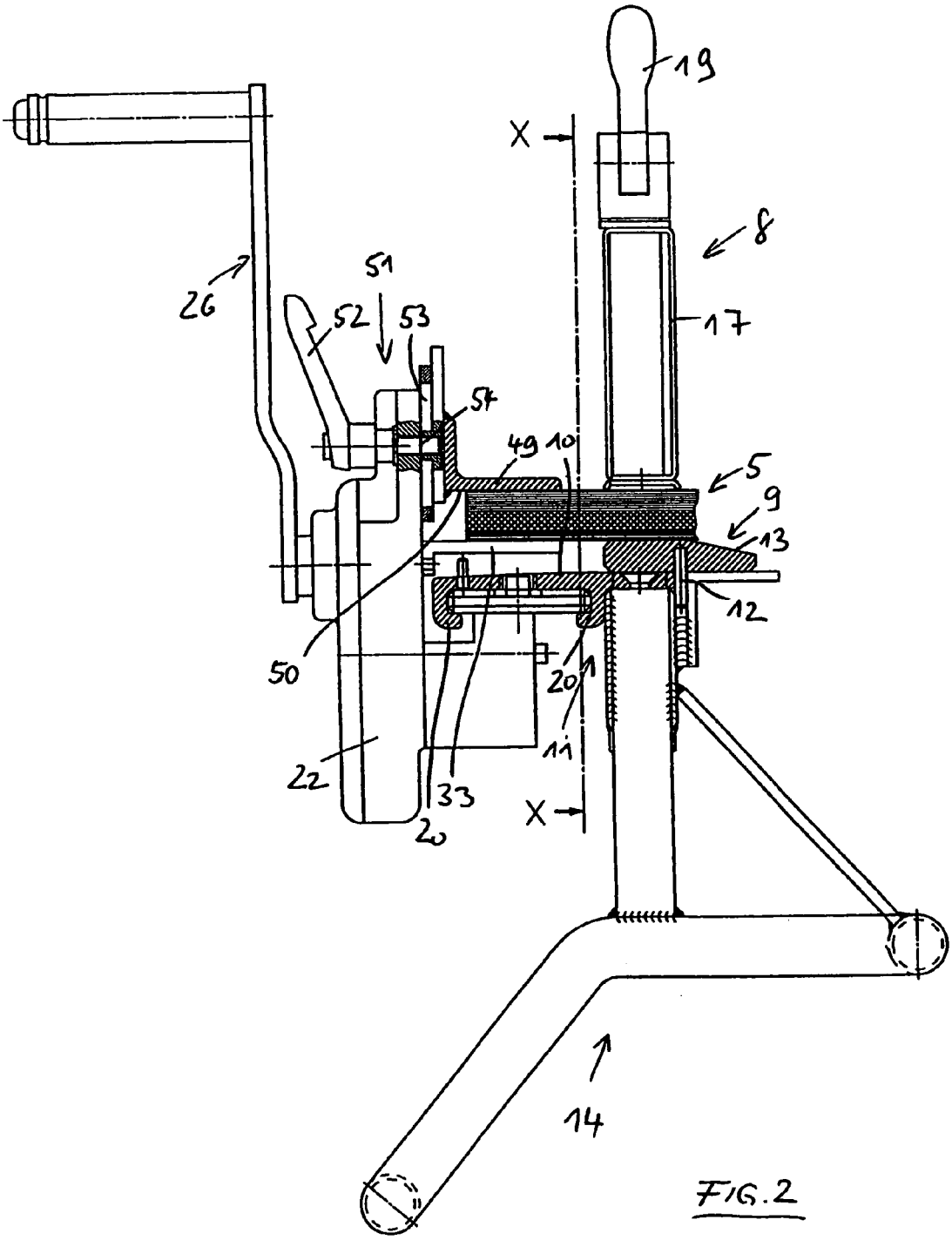

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The following description of figures refers to the representation of FIGS. 1 to 5, with which the belt skiver mechanism 1 for separating surface layers, namely an upper surface layer 2 and a lower surface layer 3, from an associated conveyor belt 5. A cutting head portion of belt skiver mechanism 1 is shifted laterally along an end 4 of conveyor belt 5, and is mounted on a stationary control mechanism 6, whereby the stationary control mechanism 6 forms one structural unit with a support mechanism 7 for the conveyor belt 5. The support mechanism 7 has a clamping mechanism 8 arranged for clamping the conveyor belt 5 between support mechanism 7 and clamping mechanism 8.

Conveyor belt 5 exhibits dimensions in accordance with the requirements of a particular application. The width of the conveyor belt 5 can be up to 2 meters, with a thickness of around 25 millimeters. For example, conveyor belt 5 may have a multilayer construction made out of rubber. Such conveyor belts 5 are typically quite heavy, and are therefore to be handled only with great physical effort.

In the typical method for interconnecting opposite ends of conveyor belt 5, the conveyor belt 5 is cut off in the area of both of its ends in a manner that is perpendicular to its running direction. The belt skiver mechanism 1 serves the purpose of forming recesses in the opposite faces of each belt end 4 by separating an upper surface layer 2 and a lower surface layer 3 from the ends of the conveyor belt 5, whereby separating the two surface layers 2 and 3 is effected in a processing step using the belt skiver mechanism 1.

The support mechanism 7 and the clamping mechanism 8 serve the purpose of positioning the end 4 of conveyor belt 5 in a stationary manner. The support mechanism 7 (mounted on a stationary basis) has a supporting plate 9 for the conveyor belt 5, which rests upon a base plate 10. An assembly portion 11 of the belt skiver mechanism 1 includes the stationary control mechanism 6 and the support mechanism 7. This assembly portion 11 is provided with various pins 12, which engage from the underside in special rods inserted in the base plate 10, so that supporting plates 9 of various thicknesses can be used according to the thickness of the particular conveyor belt 5. These supporting plates 9 are provided with an insertion chamfer 13, such that the conveyor belt 5 can be easily inserted between the support mechanism 7 and the clamping mechanism 8.

The support mechanism 7 and the stationary control mechanism 6 are reinforced by a tubular frame 14 along with struts 15 and 16 that are horizontally and vertically arranged on frame 14. In the horizontally arranged strut 15, the clamping mechanism 8 is mounted in a manner so that it is able to be set. The clamping mechanism 8 has a clamping bar 17 for clamping the conveyor belt end 4 between bar 17 and the clamping plate 9. Threaded rods 18 for setting the clamping bar 17 are mounted adjacent the two lateral ends of bar 17, and have nuts (not shown) that are mounted in the clamping bar 17 which work together with the threaded rods 18 when pivoted by means of crank handles 19.

Figure 3:
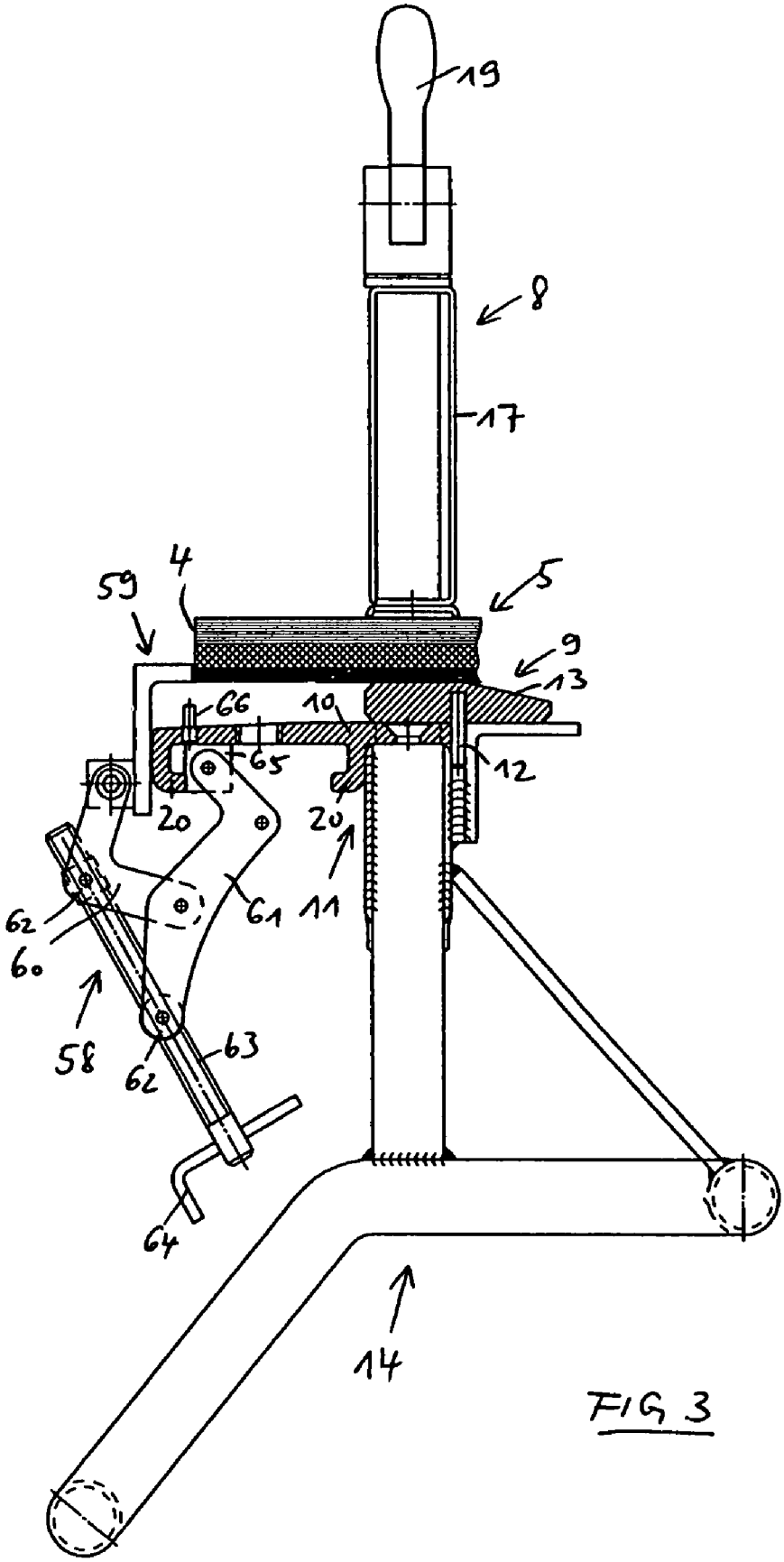
Figure 4:
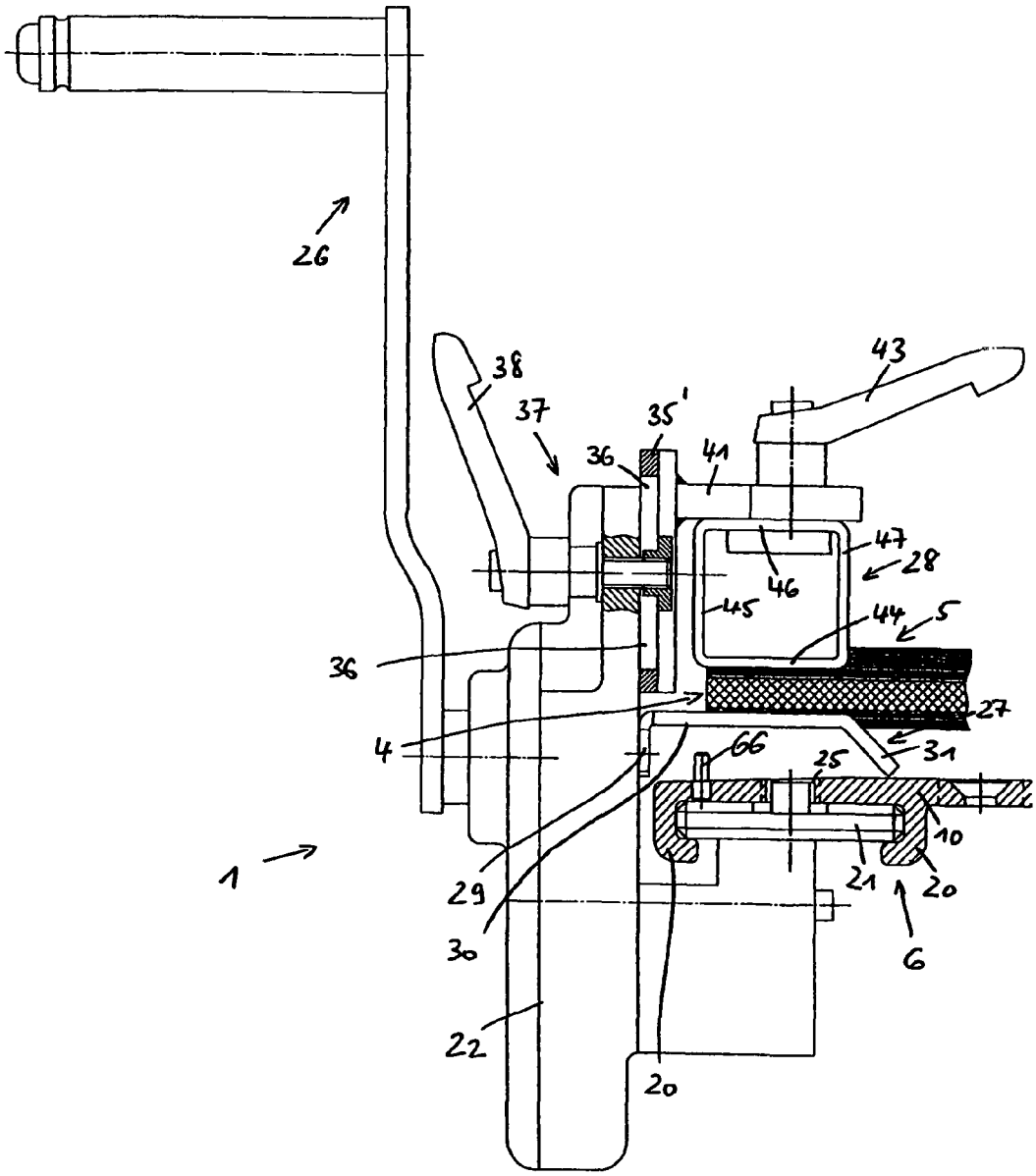
Figure 5:
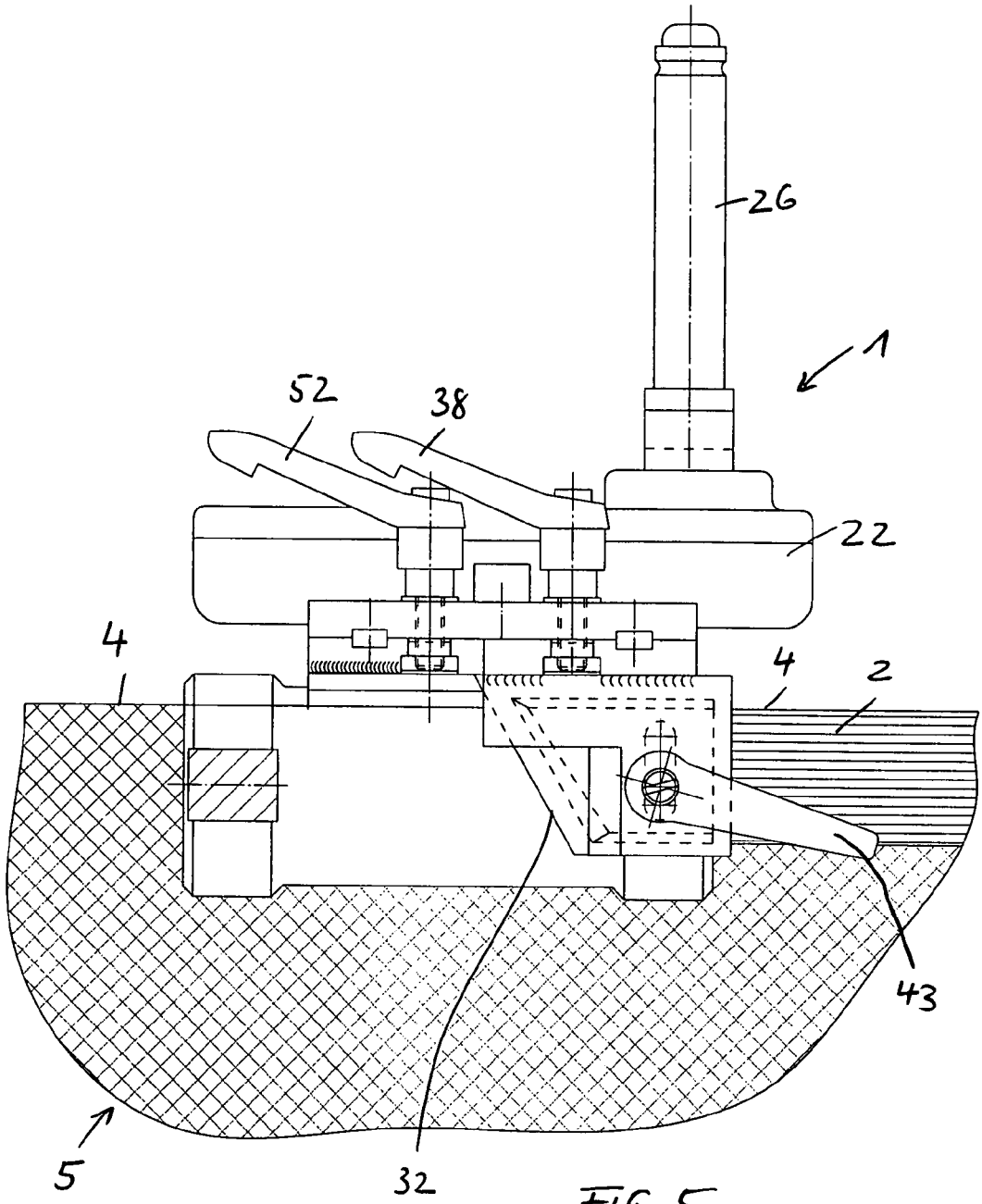

FIG. 3 illustrates the aligning of the conveyor belt 5 before clamping the same in place by clamping mechanism 8. For alignment, an alignment mechanism 58 is connected with the base plate 10 adjacent the outside portion of two control lugs 20, which is provided with a stopper 59. The end 4 of conveyor belt 5 is aligned by stopper 59 and then clamped in the aligned position by clamping mechanism 8. Subsequently, the alignment mechanism 58 is retracted, and thereby clears the area of the traverse path in which belt skiver mechanism 1 travels for separating surface layers 2 and 3. Typically, at least two alignment mechanisms 58 are spaced from one another in intervals along the base plate 10, in order to be able to precisely align the end 4 of conveyor belt 5.

The alignment mechanism 58 exhibits, for example, two pivoting connected bell cranks 60 and 61, which are pivotally connected with a spindle 63 by pins 62 to adjust the bell cranks 60 and 61. Spindle 63 is manually adjustable by means of a lever 64. The stopper 59 is detachably mounted on the bell crank 60. The bell crank 61 incorporates a trunnion mounting 65, which serves to attach the base plate 10 to the control lug 20.

The underside of base plate 10 has control lugs 20 that are arranged in spaced apart intervals, extend in the width direction of the conveyor belt 5, and incorporate a control shoe 21 portion of belt skiver mechanism 1 for separating surface layers 2 and 3 from the conveyor belt end 4. Thus, through control shoe 21, the belt skiver mechanism 1 is movable relative to the assembly unit 11.

The belt skiver mechanism 1 has a housing 22, which with control shoe 21 form a single assembly. The housing 22 incorporates an actuator (which is not individually illustrated) for moving the belt skiver mechanism 1 alongside the control mechanism 6. The actuator has a pinion 24 pivoting around an axis 23, which engages a rack or perforated rod portion of control mechanism 6.

Holes are inserted in the base plate 10 between the two control lugs 20, whereby a hole 25 is illustrated. To rotate the pinion 24, a crank handle 26 is provided, whereby a reduction gear (not shown) is effective between the crank handle 26 and the pinion 24 to provide mechanical advantage.

In the illustrated embodiment, conveyor belt 5 is clamped between support mechanism 7 and clamping mechanism 8, and the belt skiver mechanism 1 moves relative to such mechanisms.

On the side oriented toward support mechanism 7 and/or the clamping mechanism 8, the belt skiver mechanism 1 has two knife-forming blades 27 and 28. The lower blade 27 serves the purpose of separating the lower surface layer 3 on one side or face of the conveyor belt 5, and the other upper blade 28 serves the purpose of separating the upper surface layer 2 on the opposite side or face of the conveyor belt 5.

In the example of the illustrated embodiment, the lower blade 27 is mounted on the housing 22 of belt skiver mechanism 1 in a manner that is vertically adjustable, and is therefore bolted to housing 22 within the area of a cut or edge 29. A horizontally running section 30 of the lower knife-forming blade 27 follows edge 29, at which point, an additional section 31 of lower blade 27 follows, which is slanted diagonally downwardly. The cutting edge along sections 30 and 31 of the blade 27 is identified with the reference number 32. Cutting edge 32 runs, as is to be particularly taken from the presentation of FIG. 1, not perpendicularly to the operating direction of belt skiver mechanism 1, but at an angle to this, such that the area of blade section 30 initially enters the conveyor belt 5, and then, with progressive movement of the belt skiver mechanism 1, the section 30 completely enters belt end 4, and finally the blade section 31 continues the cutting process. As to be particularly taken from the presentation of FIGS. 1 and 2, related to the direction of motion of the conveyor belt 5, a lower guide plate 33 is securely connected with the housing 22 before the lower blade 27, whereby the upper, horizontally arranged bearing surface 34 of the guide plate 33 is located on a deeper level than the cutting edge 32 in the area of the horizontal section 30 of the blade 27. However, the lower cutting edge 32, within the area of the blade section 31 (which is directed downward), rises up under the level of the surface 34 of the lower guide plate 33.

As is to be understood from the presentation of FIG. 1, the lower blade 27 is provided with vertically arranged slotted holes 35, such that the position of lower blade 27 can be vertically adjusted, as well as the horizontal orientation of section 30 of the lower blade 27.

With reference to the upper knife-forming blade 28, the housing 22 incorporates a base plate 35, which is provided with a vertical slotted hole 36. A clamping mechanism 37, which is able to be operated by means of a handle 38, allows for locking base plate 35 in place after shifting the same upward or downward in a vertical direction. Handle 38 has a clamping bevel thereon (which is not shown) and a pin 39, which is inserted through slotted hole 36 and into a clamping shoe 40, causing the clamping action between clamping shoe 40 and base plate 35. An additional base plate 41 is firmly connected in the area of the upper end of base plate 35', and is provided with a corresponding tightener 42 with a handle 43 for operation along with a pin that is not shown. As is to be taken from the presentation in FIG. 3, base plate 41 mounts upper blade 28, having a square in the cross-sectional shape. Therefore, by means of the tightener 37, upper blade 28 can be adjusted in a vertical direction, and by means of the tightener 42, upper blade 28 can be adjusted in a horizontal direction.

The four sections of the upper blade 28 (FIG. 4) are identified by the reference symbols 44, 45, 46 and 47. As is to be taken from the presentation of FIG. 1, the cutting edge 48, which thus describes the form of a square, is vertically oriented and similarly becomes effective when the forward moving area of the cutting edge 32 of the lower blade 27 becomes effective upon the impact of the conveyor belt 5.

Moreover, an upper guide plate 49 is associated with upper blade 28, whose lower surface 50 contacts the upper surface of the conveyor belt 5 before the upper surface layer 2 of conveyor belt end 4 is severed or cut. A tightener 51, which is formed similar to the previously described tightener 37, has an upper guide plate 49 that is vertically adjustable without any further step. Tightener 51 has a handle identified with the reference number 52, a slotted hole 53, and a pin 54.

As it is to be taken from the presentation of FIGS. 1 to 5, the belt skiver mechanism 1 is adjusted in such a way that the guide plates 33 and 49 are adjusted to the thickness of the conveyor belt 5, such that the conveyor belt is supported with little clearance between the two guide plates. The two blades 27 and 28 are likewise adjusted in accordance with the desired thickness of the lower surface layer 3 and/or upper surface layer 2 to be removed, with the upper blade 28 also being horizontally adjustable.

In operation, with the clamping bar 17 in a raised, open position, the conveyor belt 5, with its front end at the supporting plate 9, is pushed or inserted between the two guide plates 33 and 49 into a defined position against the alignment mechanism 58. Then, by operation of the crank handles 19, the clamping bar 17 is lowered and clamps the conveyor belt 5 against the supporting plate 9, with the upper horizontal surface of conveyor belt 5 positioned at the level of surface 34 of the lower guide plate 33. The alignment mechanisms 58 are then retracted. Subsequently, the belt skiver mechanism 1 will proceed by operation of the crank handle 26, whereby the two blades 27 and 28 contact the adjacent side edge of the conveyor belt 5 and commence cutting through the same along belt end 4. As belt skiver mechanism 1 travels over the entire width of the conveyor belt end 4, the upper surface layer 2 and the lower surface layer 3 are contemporaneously severed and/or separated from the conveyor belt 5.

Figure 7:
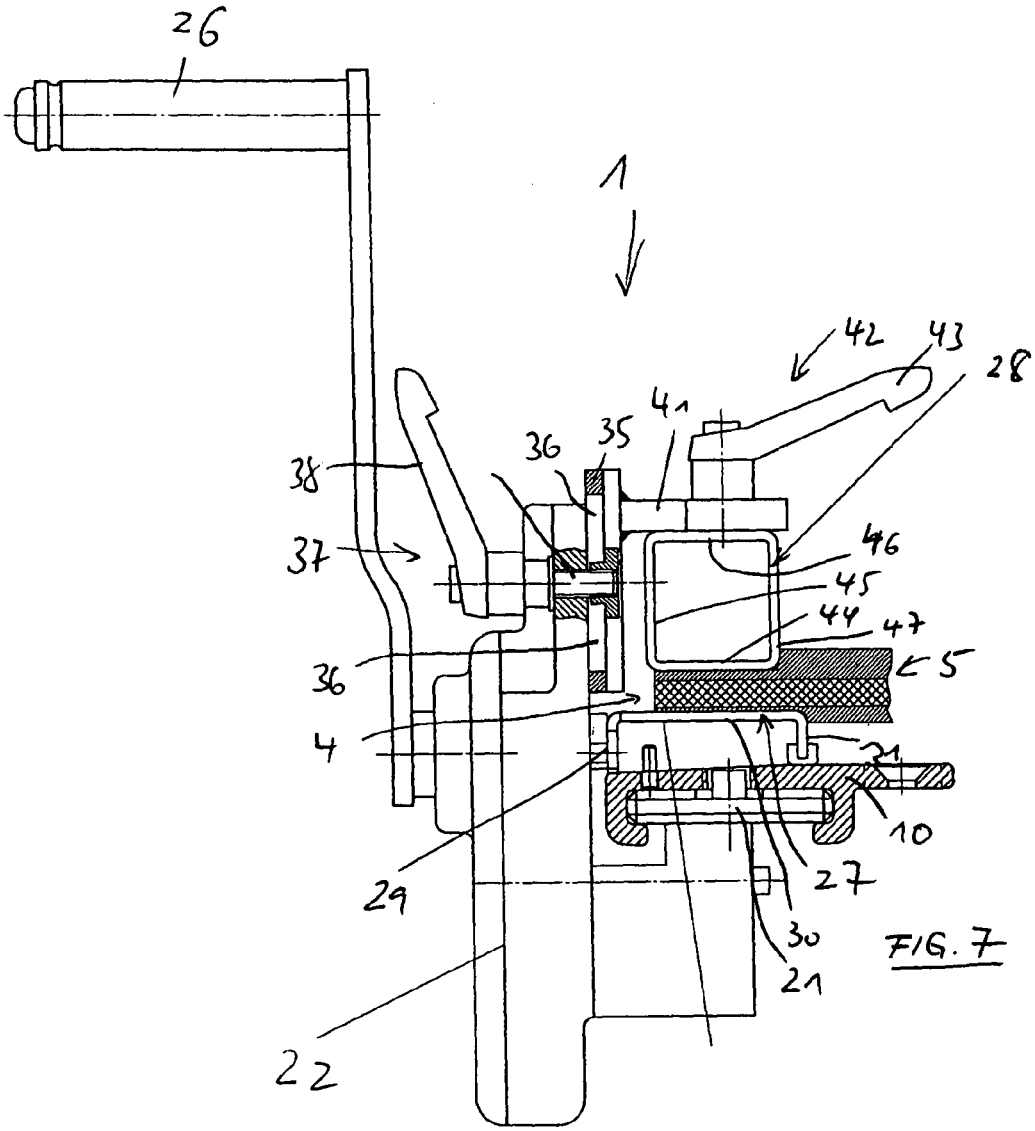

FIG. 7 illustrates an alternative embodiment of belt skiver mechanism 1, wherein the lower blade 27 is formed in a manner that is slightly different than the lower blade with the embodiment shown in FIGS. 1 to 5. In the embodiment shown in FIG. 7, the lower blade is arranged in U-form, thus its section 31 runs in a right angle to section 30. Moreover, the section 31 of the blade 27 is supported by the base plate 10.

Figure 6:
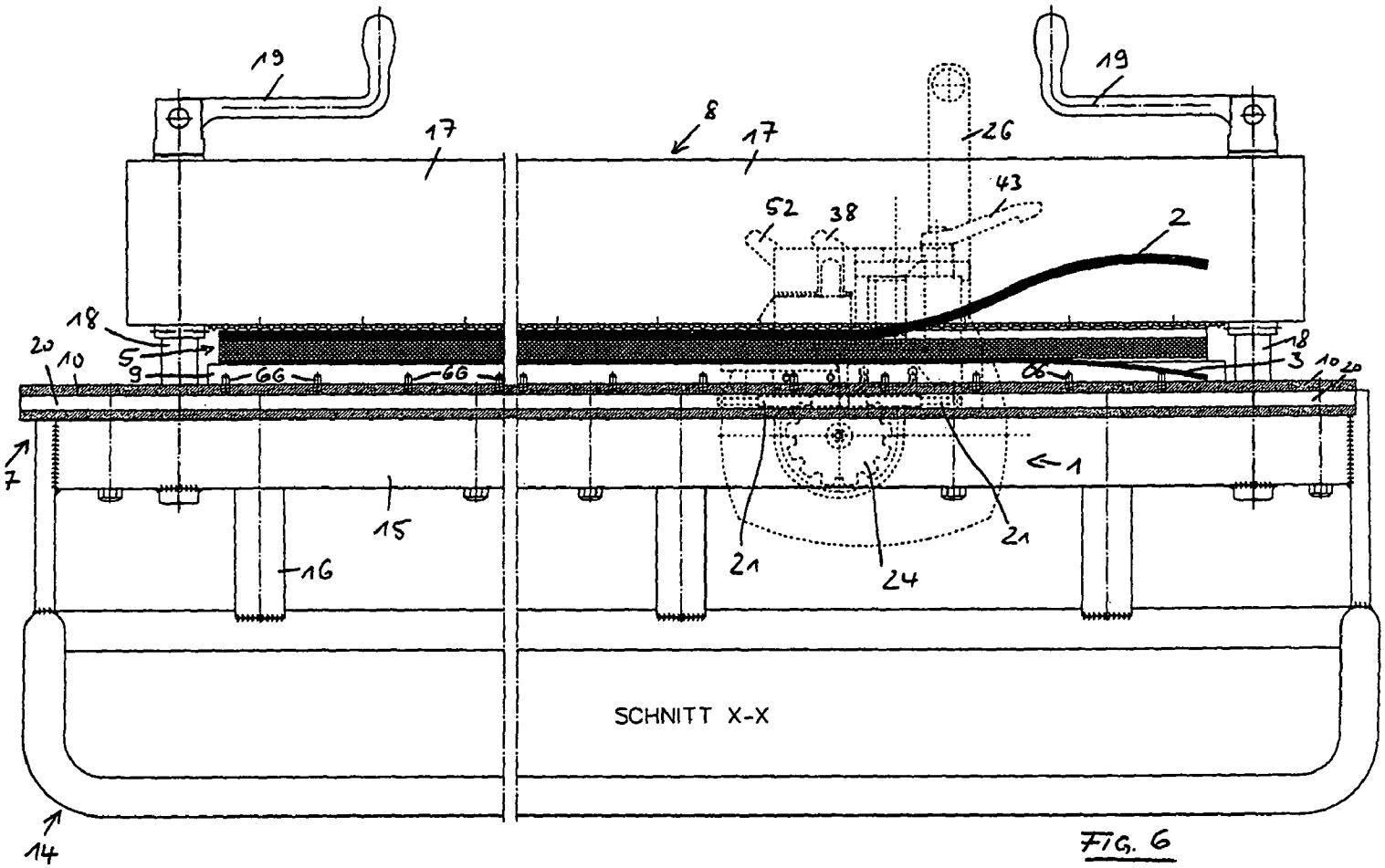
Figure 8:
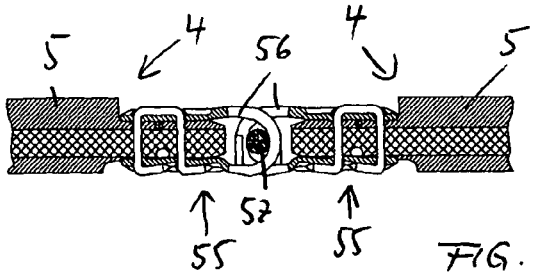

FIG. 8 shows one example of the connection of two adjacent ends 4 of the conveyor belt 5, which, in the illustrated method, are provided with lacings or belt connectors 55, having eyes 56 mounted on the opposing ends 4 of the conveyor 5 that are positioned in an intermeshed or overlapping arrangement, with a connector pin or rod 57 inserted through eyes 56. In the embodiment shown in FIG. 8, the upper surface layer 2 and the lower surface layer 3 of conveyor belt 5 are removed along belt end 4, wherein the associated recesses are formed by the blades 27 and 28 of the belt skiver mechanism 1 shown in FIG. 6.

It is to be understood that belt skiver mechanism 1 and supporting plate 9 can be removed from assembly unit 11, and another functional mechanism mounted between the control lugs 20, so that belt connectors 55 can be connected with respective belt end 4 after the surface layers 2 and 3 are removed from the conveyor belt 5. In such a case, a plurality of pin-forming projections 66, which extend above the base plate 10, serve the purpose of aligning the various belt connectors 55 relative to the base plate.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a belt skiver configured to form recesses along an end of a conveyor belt in preparation for mounting a belt connector therein, the improvement comprising:

a clamping mechanism having generally flat opposed surfaces configured to engage top and bottom surfaces of the conveyor belt to securely, yet removably retain the conveyor belt in position, with a free conveyor belt end protruding outwardly of said clamping mechanism in a cantilevered fashion;

a belt cutting mechanism movable relative to said clamping mechanism, and having an upper belt cutting blade configured with mutually angled portions positioned to slice simultaneously both longitudinally and transversely into and through a top portion of the free conveyor belt end and remove an upper surface layer strip therefrom, and a lower belt cutting blade configured with mutually angled portions positioned to slice simultaneously both longitudinally and transversely into and through a bottom portion of the free conveyor belt end and remove a lower surface layer strip therefrom; and a drive mechanism shifting said belt cutting mechanism and said clamping mechanism relative to each other laterally along the free conveyor belt end, whereby as said drive mechanism shifts said belt cutting mechanism and said clamping mechanism relative to each other, both the upper surface layer strip and the lower surface layer strip are substantially contemporaneously severed from the top portion and the bottom portion of the free conveyor belt end to create precisely aligned upper and lower recesses which are adapted to receive and mount an associated belt connector therein; and an upper guide plate operably connected with said belt cutting mechanism and generally aligned with said upper belt cutting blade at a location forwardly thereof in the direction of cutting motion; and a lower guide plate operably connected with said belt cutting mechanism and generally aligned with said lower belt cutting blade at a location forwardly thereof in the direction of cutting motion; said upper and lower guide plates being disposed in a generally parallel relationship for guiding the conveyor belt end therebetween.

2. A belt skiver as set forth in claim 1, wherein:

said upper and lower guide plates are mutually adjustable in the direction of the thickness of the conveyor belt end to facilitate skiving conveyor belt ends of different thicknesses.

3. A belt skiver as set forth in claim 2, wherein:

at least one of said upper and lower belt cutting blades is adjustable in the direction of the thickness of the conveyor belt end to facilitate forming recesses of different depths.

4. A belt skiver as set forth in claim 3, wherein:

at least one of said upper and lower belt cutting blades is adjustable in the direction perpendicular to the thickness of the conveyor belt end to laterally stagger the relative position of said upper and lower belt cutting blades.

5. A belt skiver as set forth in claim 4, wherein:

said upper blade includes a first cutting edge, and said lower blade includes a second cutting edge that is arranged in a generally parallel relationship with said first cutting edge.

6. A belt skiver as set forth in claim 5, wherein:

at least a portion of said second cutting edge of said lower blade is disposed forwardly of said first cutting edge of said upper blade in the direction of cutting motion.

7. A belt skiver as set forth in claim 6, wherein:

said upper blade has a first portion, and a second portion disposed rearwardly of said first portion in the direction of cutting motion and having two edge sections.

8. A belt skiver as set forth in claim 7, wherein:

said two edge sections of said upper blade are arranged at an angle in the range of 90 to 180 degrees relative to each other.

9. A belt skiver as set forth in claim 8, wherein:

said lower blade has a first portion, and a second portion disposed rearwardly of said first portion of said lower blade and having two edge sections arranged at an angle in the range of 90 to 180 degrees relative to each other.

10. A belt skiver as set forth in claim 9, wherein:

said upper blade and said lower blade each comprise a bend-resistant knife.

11. A belt skiver as set forth in claim 10, including:

a stationary support mechanism in which the conveyor belt end is clamped; and wherein said drive mechanism shifts said cutting mechanism relative to the conveyor belt end.

12. A belt skiver as set forth in claim 11, including:

a stationary control mechanism connected with said support mechanism and slidingly supporting said cutting mechanism thereon for shifting the same laterally along the conveyor belt end.

13. A belt skiver as set forth in claim 12, wherein:

said drive mechanism includes an actuator with a pinion gear which engages a rack portion of said control mechanism.

14. A belt skiver as set forth in claim 13, wherein:

said drive mechanism includes a handle for rotating said pinion gear, and includes a gear reduction mechanism to achieve a mechanical advantage.

15. A belt skiver as set forth in claim 14, wherein:

said control mechanism includes control lugs between which said cutting mechanism is slidingly supported.

16. A belt skiver as set forth in claim 1, wherein:

said drive mechanism shifts said cutting mechanism, and the conveyor belt end is stationary.

17. A belt skiver as set forth in claim 16, including:

a clamping mechanism selectively retaining the conveyor belt end in a predetermined relationship relative to said cutting mechanism during cutting motion.

18. A belt skiver as set forth in claim 17, wherein:

said clamping mechanism includes a plurality of different support plates in various thicknesses configured for detachably mounting in said belt skiver to accommodate conveyor belt ends of different thicknesses.

19. A belt skiver as set forth in claim 18, including:

a retractable stopper selectively abutting the conveyor belt end to position the conveyor belt end in a predetermined spatial relationship with respect to said cutting mechanism.

20. A kit for interconnecting first and second opposite ends of a conveyor belt, comprising:

a belt skiver including a clamping mechanism configured to engage top and bottom surfaces of the conveyor belt to securely, yet removably retain the conveyor belt in position, with a free conveyor belt end protruding outwardly thereof in a cantilevered fashion, a belt cutting mechanism movable relative to said clamping mechanism, and having an upper belt cutting blade configured with mutually angled portions positioned to slice simultaneously both longitudinally and transversely into and through a top portion of the free conveyor belt end and remove upper surface layer strips therefrom, a lower belt cutting blade configured with mutually angled portions positioned to slice simultaneously both longitudinally and transversely into and through a bottom portion of the free conveyor belt end and remove lower surface layer strips therefrom, and a drive mechanism laterally shifting said belt cutting mechanism and said clamping mechanism relative to each other, whereby both the upper surface layer strip and the lower surface layer strip are substantially contemporaneously severed from the top portion and the bottom portion of each conveyor belt end to create precisely aligned upper and lower recesses along both the first and second ends of the conveyor belt; and a mechanical belt fastener having first end portions thereof received and mounted in the upper and lower recesses in the first conveyor belt end, and second end portions thereof received and mounted in the upper and lower recesses in the second conveyor belt end such that said belt fastener spans between and interconnects the first and second ends of the conveyor belt; and an upper guide plate operably connected with said belt cutting mechanism and generally aligned with said upper belt cutting blade at a location forwardly thereof in the direction of cutting motion; and a lower guide plate operably connected with said belt cutting mechanism and generally aligned with said lower belt cutting blade at a location forwardly thereof in the direction of cutting motion; said upper and lower guide plates being disposed in a generally parallel relationship for guiding the conveyor belt end therebetween.

21. A kit as set forth in claim 20, wherein:

said upper and lower guide plates are mutually adjustable in the direction of the thickness of the conveyor belt ends to facilitate skiving conveyor belt ends of different thicknesses.

22. A kit as set forth in claim 21, wherein:

at least one of said upper and lower belt cutting blades is adjustable in the direction of the thickness of the conveyor belt ends to facilitate forming recesses of different depths.

23. A kit as set forth in claim 22, wherein:

at least one of said upper and lower belt cutting blades is adjustable in the direction perpendicular to the thickness of the conveyor belt ends to laterally stagger the relative position of said upper and lower belt cutting blades.

* * * * *